United States Patent [19]

Tandon et al.

[11] 4,291,365

[45] Sep. 22, 1981

[54] SIGNAL LANTERNS FOR OPTIONAL COLORED LIGHT EMITTANCE

[76] Inventors: Amar N. Tandon, P.O. Box 189 Aishbagh; Ram B. Bhasin, 3/2 Talkatora Colony, both of Lucknow, India

[21] Appl. No.: 115,791

[22] Filed: Jan. 28, 1980

[51] Int. Cl.[3] ..... F21V 9/00

[52] U.S. Cl. ..... 362/281; 362/293; 362/311; 362/361; 362/208

[58] Field of Search ..... 362/281, 293, 311, 361

[56] References Cited

U.S. PATENT DOCUMENTS 3,868,501 2/1975 Barbour ..... 362/281

*Primary Examiner*—Stephen J. Lechert, Jr.
*Attorney, Agent, or Firm*—Holman & Stern

[57] ABSTRACT

This invention concerns an attachment in and for a signalling lantern in which there are provided coaxial substantially transparent tubular bodies having mutual guide means so as to be movable along their common axis, said tubular bodies being held in support-cum-guide means adapted to be mounted on face (reflector side) of the lamp and rotary means to advance on rotation thereof (said rotary means) in one direction of one or the first tubular body to envelope the light source, such rotation causing retraction of the second tubular body if it already enveloped the light source and uncovering of the latter, while rotation of the rotary means in the other direction causing said first tubular body to retract and uncover the light source and the second tubular body to advance and cover the said light source, each said tubular body or at least that portion of each as will cover the light source being of different color.

8 Claims, 8 Drawing Figures

SIGNAL LANTERNS FOR OPTIONAL COLORED LIGHT EMITTANCE

This invention relates to an attachment for a lamp with a reflector, particularly, for a signalling lamp, such as a flashlight and to a flashlight fitted with such attachment.

Portable signalling lamps still need improvement to enable colour of light flashed to be changed from one to an other colour.

Ordinarily a flashlight or a lantern which is a portable source of light is used to give long bright beam of white light or light of any other colour depending upon whether the glass covering the light source is colourless or coloured. Change of colour of a beam of light from such lamps is effected by changing the cover glass.

The object of this invention is to provide an improved attachment for the purpose to be used in signalling lamps having a reflector, so that beam of light that it flashes will be of one or the other desired colour.

A further object of the invention is to maintain flashing of white beam of light in addition to the alternatives of two coloured beams.

To achieve this object it is proposed to arrange to cover at will the source of light, such as a bulb in an electric flashlight, with a transparent tubular body of one or the other desired coloured so that the light source would emit light of a particular colour to be reflected by the surrounding reflector as a beam of light of that particular colour.

According to one aspect of this invention there is provided an attachment for a lamp, particularly for a signalling lamp, said lamp including a reflector, such as a flashlight, said attachment adapted to be mounted opposite light source, such as bulb, of the lamp, and comprising two co-axial substantially transparent tubular bodies having mutual guide means so as to be movablealong their common axis, said tubular bodies being held in support-cum-guide means adapted to be mounted on face (reflector side) of the lamp and rotary means such as herein described to advance on rotation thereof (said rotary means) in one direction of one or the first tubular body to envelope the light source, such rotation causing retraction of the second tubular body if it already enveloped the light source and uncovering of the latter, while rotation of the rotary means in the other direction causing said first tubular body to retract and uncover the light source and the second tubular body to advance and cover the said light source, each said tubular body or at least that portion of each as will cover the light source being of different colour.

In one embodiment of the attachment according to this invention said tubular bodies are supported by mounting on means comprising a right hand left hand screw, one said tubular body being slidable on right hand part of the screw and the other on the left hand part of the screw and means to rotate the screw so that when one of the tubular bodies advances towards the light source to cover it (the light source) the other retracts therefrom.

The last mentioned attachment may be mounted at the centre of a cup shaped body in a cylindrical member concentric to said cup-shaped body, the base at least of which cup-shaped body is substantially transparent.

In another embodiment of the attachment described above it comprises a cup-shaped body as support means base at least of which (cup shaped body) is substantially transparent, a central vertical guide member around which the two tubular bodies are disposed, four vertical slots in the walls of said cup-shaped body, being 90° apart from each other, two arms diametrically oppositely disposed externally of each said tubular body, free ends of each pair of said arms resting in each opposing pair of vertical slots, a ring around said cup shaped body with four angular grooves or slots, 90° apart from each other, to which the free ends of said arms are engaged after passing through the vertical slots, arrangement being such that when the free ends of all the four arms are at bends of the angular slots/grooves the light source is not covered by either tubular body while on rotating the ring in one direction pair of arms only on one or first tubular body are caused by corresponding pair of oppositely disposed angular slots to move up in the vertical slots in which such ends rest with the result that the first tubular body moves forward to envelope the light source, and on moving the ring in the other direction, the first tubular body retracts till bends in the angular slots reach ends of the arms and further movement of the ring in the same direction causes the second tubular body to similarly advance and envelope the light source.

The invention is described further below with reference to the accompanying drawings which show flashlight lanterns of electric type to flash red or green beam of right in addition to white beam.

Figure 1:
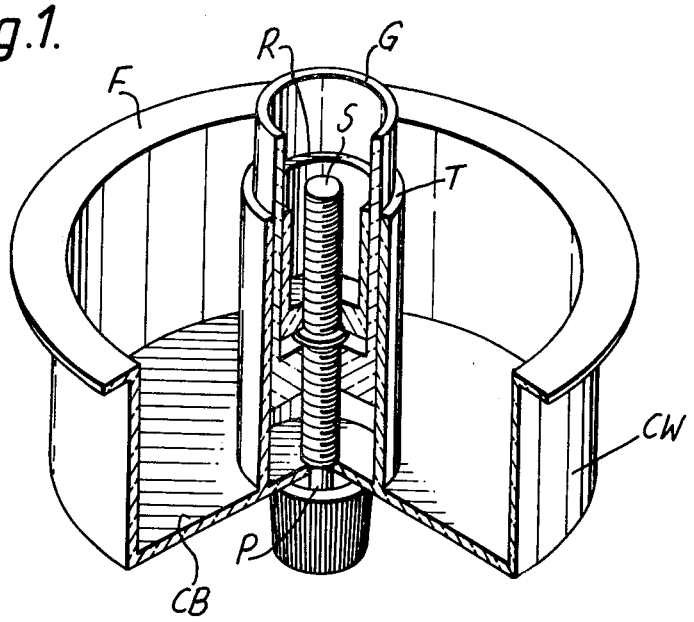
FIG. 1 shows the attachment according to one embodiment of this invention in part section in one position.
Figure 2:
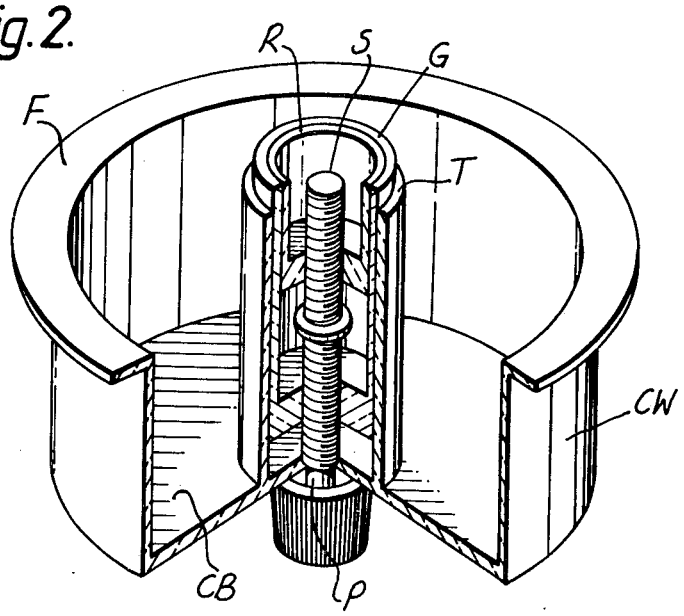
FIG. 2 shows the same in another position.
Figure 3:
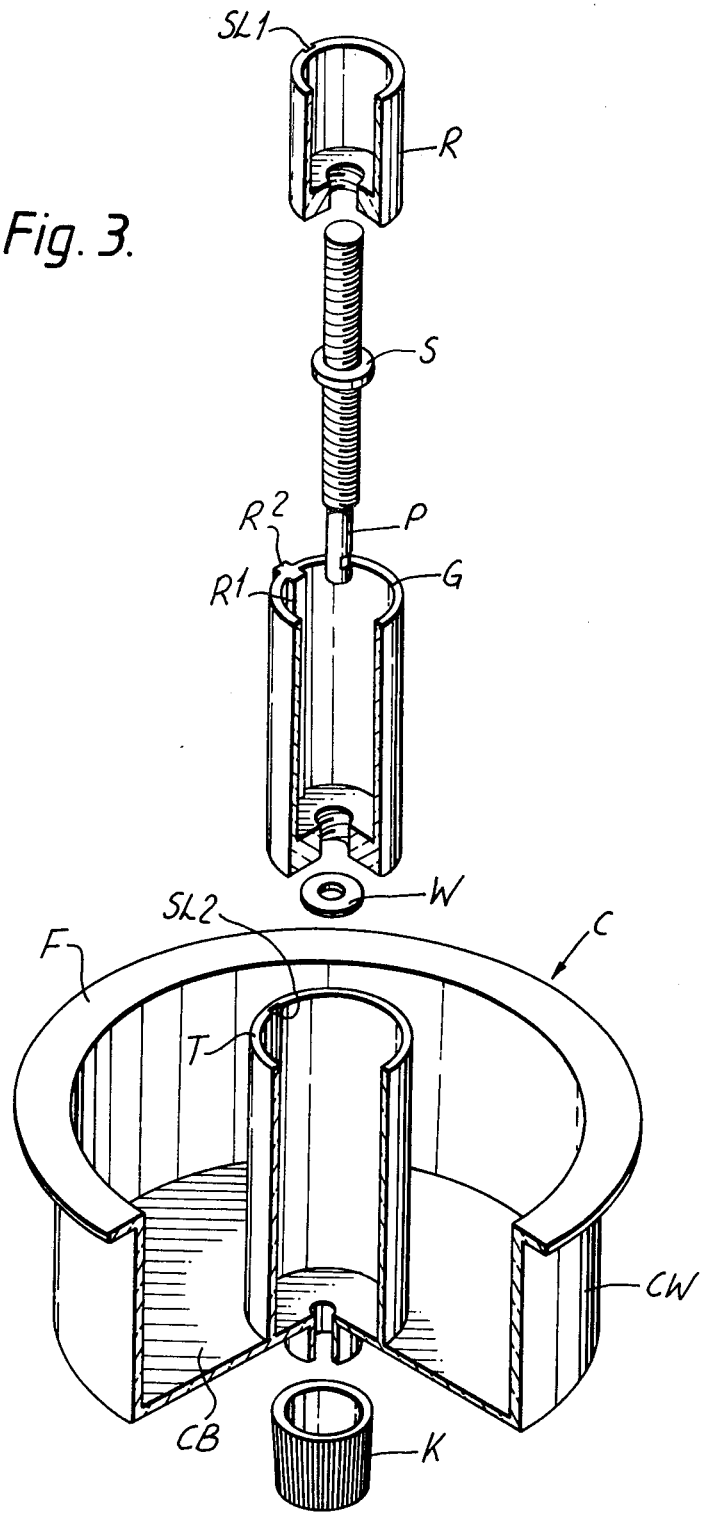
FIG. 3 is exploded view of what is shown in FIGS. 1 & 2.

Referring to FIGS. 1 to 4, concentric to a cup C is a cylinderical support-cum-guide member T. Along the longitudinal axis of the member T is mounted, at base CB of cup C, a right-hand left-hand screw S. The base CB is transparent and colourless. Walls CW of cup C may or may not be transparent but should not be coloured. Two coaxial tubular bodies R (for red) and G (for green) are mounted on left-hand and right-hand part respectively of the screw S. On a projection P of the screw S outside the base CB of the cup C, is fitted an operating knob K to turn the screw. W is a washer. SS is a collar on the screw S to limit axial movement of the tubular bodies R & C.

The attachment described above is fitted to a flashlight, a hand lantern 1. The flange F of the cup C is placed on peripheral lip of reflector 5 of the lantern 1 and locked to the lantern by a lens ring 6. Thus the cup C is invertedly held at the periphery of the reflector 5. Bulb is marked 4 and cells 2 are supported on spring 3 in the lantern.

In the position shown in figure red tubular body R surrounds the bulb 4 (light source). The light thus emitted is red coloured and a beam of red lights is reflected by the reflector 5 which passes through transparent base CB of the cup C.

When knob K is rotated the tubular body R begins to retract from the bulb 4 and body G advances to cover the bulb 4, thereby replacing red light by green light. In FIG. 1, body G is shown advanced.

Figure 4:
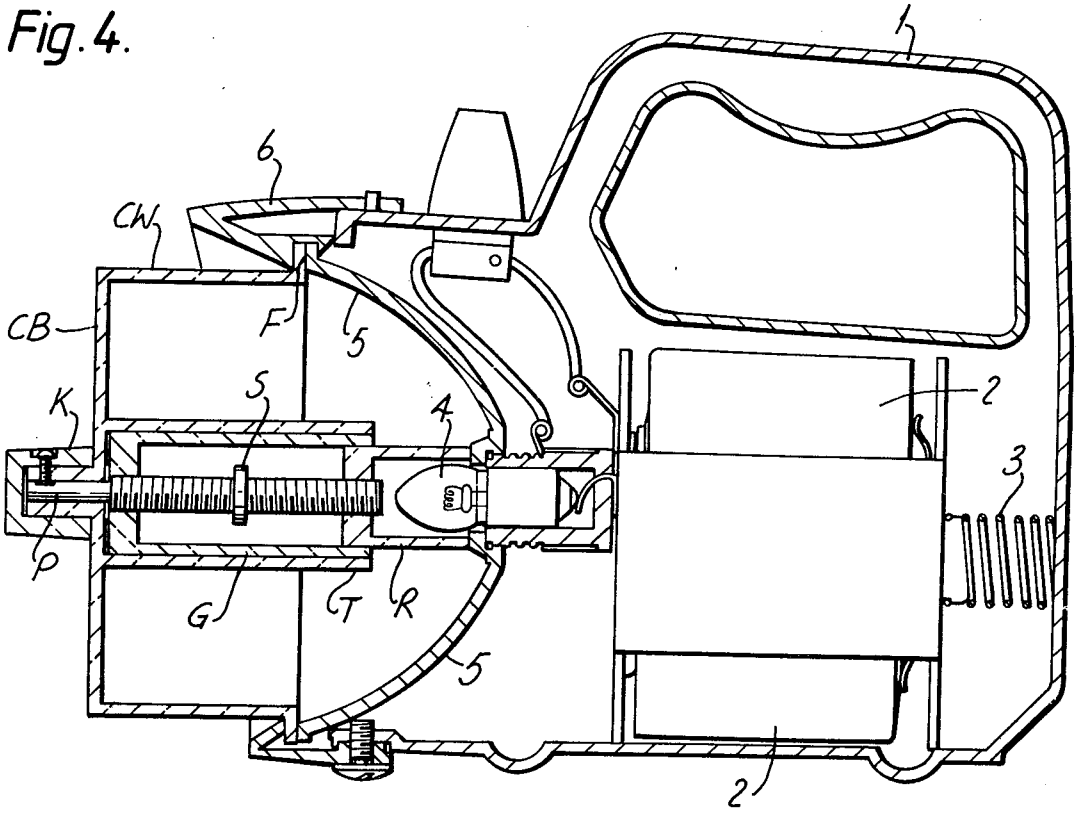
FIG. 4 shows in Section one embodiment of a lantern, according to this invention fitted with an attachment of FIGS. 1 & 2.
Figure 5:
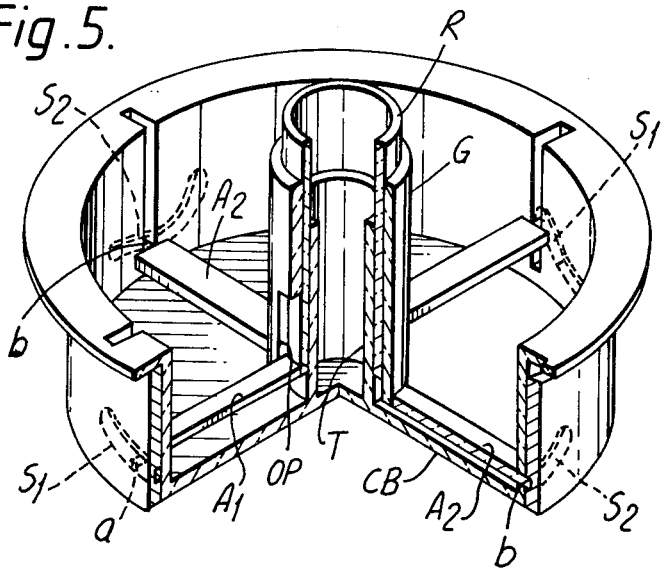
FIG. 5 shows an attachment according to another embodiment in one position.
Figure 6:
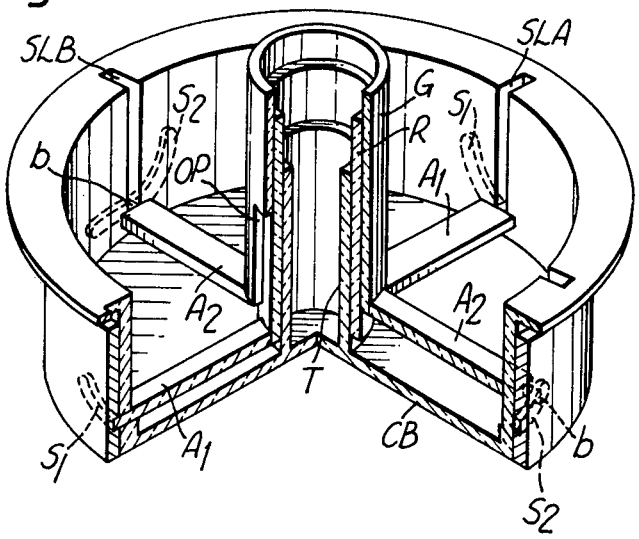
FIG. 6 shows the same as in FIG. 5 in another position.
Figure 7:
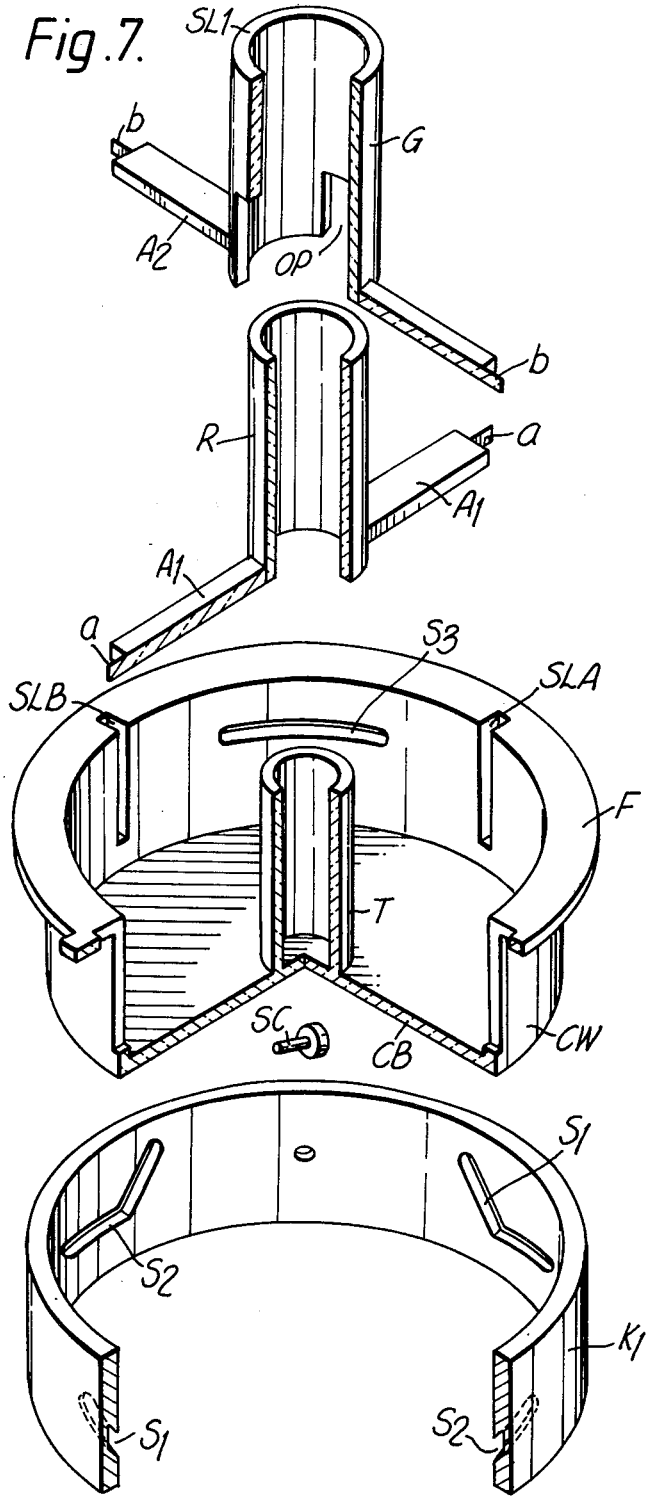
FIG. 7 is exploded view of what is shown in FIGS. 4 & 5.
Figure 8:
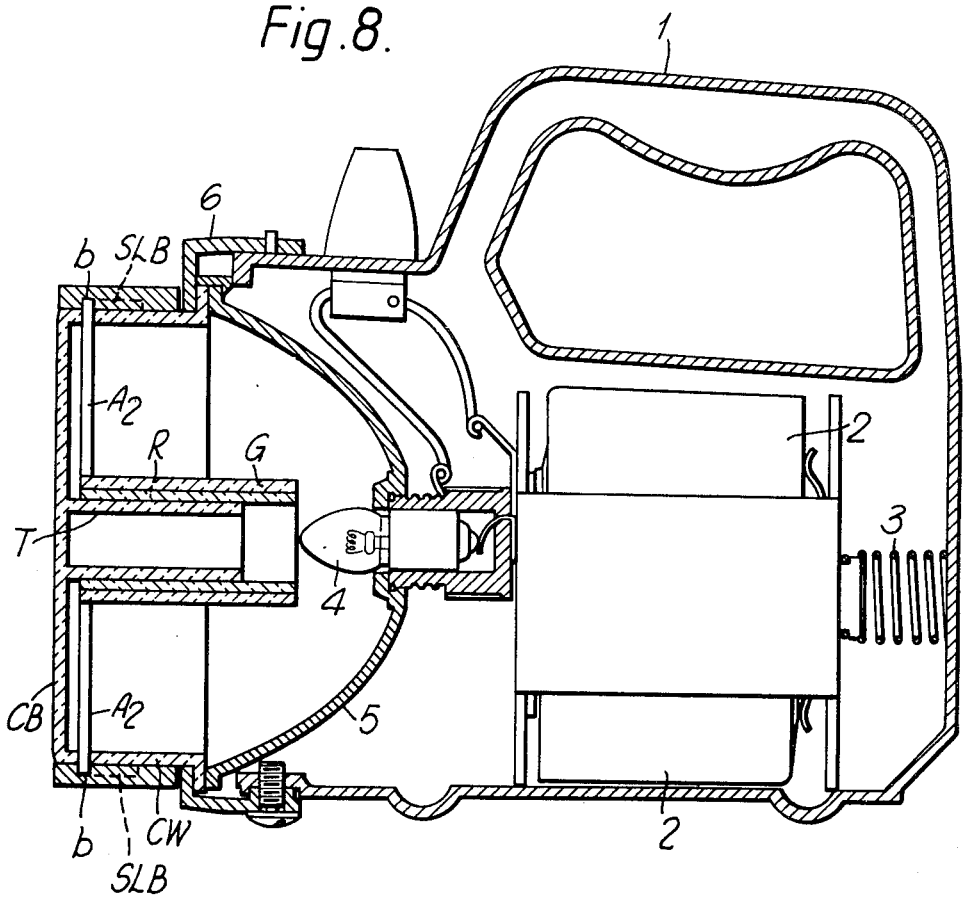
FIG. 8 shows in section a flashlight lantern fitted with attachment according to the embodiment of FIGS. 5 & 6.

During the movement of red and green tubular body R & G at one stage the two bodies overlap each other and then bulb 4 is left uncovered. In such condition a beam of only white light will be emitted. In FIG. 4 tubular bodies R & G are shown overlapping.

To facilitate guided movements of tubular bodies R & G, slots SL1 & SL2 and rails R1 & R2 are provided on support-cum-guide member T and tubular bodies R & G respectively.

Referring to FIGS. 5 to 8 the cup C has flange F, central vertical guide member T, and transparent base CB as before. Tubular bodies R & G are respectively red & Green.

Two pairs of vertical slots SLA & SLB, each equidistantly disposed—90°—from each other—are provided on the cup wall CW. A ring K1 engages the cup C externally and has two pairs of angular grooves (or slots) S1 & S2, each equidistantly disposed—90°—from each other. The angular grooves S1 & S2 are normally disposed opposite the vertical slots SLA & SLB in the cup wall CW.

Tubular body R has diametrically opposed arms A1 with reduced ends a. Similarly tubular body G has diametrically opposed arms A2 with reduced ends b. The tubular bodies R & G are concentrically disposed around the vertical member T, the arms A1 of body R being passed through openings OP in body G. The reduced ends a, b after passing through the slots SLA & SLB are engaged in angular slots S1 and S2. The ring K1 is adapted to be rotated around the cup wall CW by means of a pin SC and slot S3.

The so assembled attachment is invertedly held over the face of lamp 1 opposite the reflector, the flange F being on the peripheral lip of the reflector 5 and locked to the lantern by a lens ring 6. In the position shown in FIG. 8 both the tubular bodies are in retracted position; i.e. ends of their arms are at bends of the respective angular slots, which leaves the bulb 4 completely uncovered allowing white beams of light to be emitted and reflected by the reflector.

When the ring K1 is rotated clockwise, viewing from the front, angular slot S2 by virtue of its shape moves the ends b of arms A2 up in the slots SLB carrying the body G towards the bulb 4 which is eventually enveloped by the tubular body G so that a beam of light of green colour is emitted. Tubular body R remains stationary throughout this operation.

When the ring K1 is now rotated anti-clockwise, the body G retracts from the bulb 4 due to movement down of the arms A2 in the slot SLB guided by angular slot S2 till it (G) reaches the bend in the slot S2. This completely uncovers the bulb 4. During this movement body R remains stationary, but on further anti-clockwise movement of the ring K1 the arms A1 move up the slot SLA guided by angular slot S1 which moves the body R towards the bulb 4 which is then enveloped by the former so that a beam of red light is emitted. During this further anti-clockwise movement body G remains stationary.

When the ring K1 is now rotated clockwise, body G is retracted and further rotation of K1 advances body G to envelope the bulb 4 once more.

The cylinderical member T, in both the embodiments is preferably kept opaque to prevent any diffused light from interfering with the colour of beam of light reflected by the reflector 5. To prevent side-ways loss of light cup walls CW should also preferably be opaque.

What is claimed is:

1. Attachment for a lamp, particularly for a signalling lamp, said lamp including a reflector, such as a flashlight, said attachment adapted to be mounted opposite light source, such as bulb, of the lamp, and comprising two co-axial substantially transparent tubular bodies having mutual guide means so as to be movable along their common axis, said tubular bodies being held in support-cum-guide means adapted to be mounted on face (reflecttor side) of the lamp and rotary means such as herein described to advance on rotation thereof (said rotary means) in one direction of one or the first tubular body to envelope the light source, such rotation causing retraction of the second tubular body if it already enveloped the light source and un-covering of the latter, while rotation of the rotary means in the other direction causing said first tubular body to retract and uncover the light source and the second tubular body to advance and cover the said light source, each said tubular body or at least that portion of each as will cover the light source being of different colour.

2. Attachment as claimed in claim 1 in which said tubular bodies are mounted on a right hand left hand screw, one said tubular body being slidable on right hand part of the screw and the other on the left hand part of the screw and means to rotate the screw so that when one of the tubular bodies advances towards the light source to cover it (the light source) the other retracts thereform.

3. Attachment as claimed in claim 2 which is mounted at the centre of a cup shaped body in a cylinderical member concentric to said cup shaped body at least the base of the cup shaped body being substantially transparent.

4. Attachment as claimed in claim 3 in which the means such as a knob to rotate the screw are mounted on the base of the cup on a projecting part of said screw.

5. Attachment as claimed in claim 1 comprising a cup shaped body, as support means, base at least of which cup-shaped body is substantially transparent, a central vertical guide member around which the two tubular bodies are disposed, four vertical slots in the walls of said cup-shaped body, being 90° apart from each other, two arms diametrically oppositely disposed externally of each said tubular body, free ends of each pair of said arms resting in each opposing pair of vertical slots, a ring around said cup shaped body with four angular grooves or slots, 90° apart from each other, to which the free ends of said arms are engaged after passing through the vertical slots, arrangement being such that when the free ends of all the four arms are at bends of the angular slots/grooves the light source is not covered by either tubular body while on rotating the ring in one direction pair of arms only on one or first tubular body are caused by corresponding pair of oppositely disposed angular slots to move up in the vertical slots in which such ends rest with the result that the first tubular body moves forward to envelope the light source, and on moving the ring in the other direction, the first tubular body retracts till bends in the angular slots reach ends of the arms and further movement of the ring in the same direction causes the second tubular body to similarly advance and envelope the light source.

6. Attachment as claimed in claim 5 in which openings are formed in the base of outer tubular body to permit the arms of the inner tubular body to pass through.

7. A flashlight comprising an attachment as claimed in any one of the foregoing claims 1 to 6 in which the walls of the support means such as the cup-shaped body have flanges and said support means or cup shaped body is invertedly held by the lens ring of the flashlight at said flanges.

8. A flashlight as claimed in claim 7 which is a hand lantern.

* * * * *